US012799653B2

(12) United States Patent
Mathews et al.

(10) Patent No.: US 12,799,653 B2
(45) Date of Patent: Nov. 17, 2026

(54) TUFTING MACHINE NEEDLE DRIVE SYSTEM

(71) Applicant: Card-Monroe Corp., Chattanooga, TN (US)

(72) Inventors: Ricky E. Mathews, Sale Creek, TN (US); Marshall A. Neely, Soddy Daisy, TN (US)

(73) Assignee: Card-Monroe, Corp., Chattanooga, TN (US)

( * ) Notice: Subject to any disclaimer, the term of this patent is extended or adjusted under 35 U.S.C. 154(b) by 0 days.

(21) Appl. No.: 18/955,324

(22) Filed: Nov. 21, 2024

(65) Prior Publication Data

US 2025/0084573 A1 Mar. 13, 2025

Related U.S. Application Data

(63) Continuation of application No. 18/185,657, filed on Mar. 17, 2023, now Pat. No. 12,234,586.

(60) Provisional application No. 63/321,944, filed on Mar. 21, 2022.

(51) Int. Cl.
*D05C 15/10* (2006.01)
*D05C 15/24* (2006.01)

(52) U.S. Cl.
CPC ..... *D05C 15/10* (2013.01); *D05C 15/24* (2013.01)

(58) Field of Classification Search
CPC ..... D05C 15/10; D05C 15/12; D05C 15/20; D05C 15/08
See application file for complete search history.

(56) References Cited

U.S. PATENT DOCUMENTS

| | | | | |
|---|---|---|---|---|
| 3,040,381 | A * | 6/1962 | Pioch | B29C 31/044 425/168 |
| 3,906,876 | A * | 9/1975 | Fitton | D05C 15/32 112/80.73 |
| 4,490,970 | A * | 1/1985 | Curl | B65G 17/08 59/79.1 |
| 5,287,819 | A * | 2/1994 | Beatty | D05C 15/20 112/80.4 |
| 5,572,939 | A * | 11/1996 | Beatty | D05C 15/20 74/591 |
| 5,706,745 | A * | 1/1998 | Neely | D05C 15/22 112/80.55 |
| 5,794,551 | A * | 8/1998 | Morrison | D05C 15/30 112/80.41 |
| 10,156,035 | B2 * | 12/2018 | Mathews | D05B 69/12 |
| 2005/0139134 | A1 * | 6/2005 | Frost | D05C 15/18 112/80.73 |
| 2008/0245181 | A1 * | 10/2008 | Morgante | D05B 69/32 74/604 |

(Continued)

FOREIGN PATENT DOCUMENTS

| | | |
|---|---|---|
| JP | 8-187676 A | 7/1996 |
| JP | 2000102689 A | 4/2000 |

*Primary Examiner* — Patrick J. Lynch
(74) *Attorney, Agent, or Firm* — Adams & Reese LLP; D. Scott Sudderth

(57) ABSTRACT

A tufting machine includes a drive system for driving reciprocation of one or more needle bars carrying a series of needles. A backing material will be fed through a tufting zone of the tufting machine, with the needles penetrating into and out of the backing material with the reciprocation of the needle bars by the drive system to form tufts of yarns in the backing material at increased production rates.

11 Claims, 5 Drawing Sheets

(56) References Cited

U.S. PATENT DOCUMENTS

2013/0180440 A1 7/2013 Hall

* cited by examiner

TUFTING MACHINE NEEDLE DRIVE SYSTEM

CROSS-REFERENCE

The present Patent Application is a Continuation of U.S. patent application Ser. No. 18/185,657, filed Mar. 17, 2023, which claims the benefit of U.S. Provisional Patent Application No. 63/321,944, filed Mar. 21, 2022.

INCORPORATION BY REFERENCE

The disclosure and figures made in U.S. patent application Ser. No. 18/185,657, filed Mar. 17, 2023 and U.S. Provisional Patent Application No. 63/321,944, filed Mar. 21, 2022, are specifically incorporated by reference herein as if set forth in their entireties.

TECHNICAL FIELD

The present disclosure relates to tufting machines, and more particularly to tufting machine needle drive systems for driving one or more needle bars of tufting machines to enable increased operational speeds, improved maintenance efficiencies, and other improvements.

BACKGROUND

The use of tufting machines for creating tufted articles, for example tufted carpets, is well-known in the art. Conventional tufting machines can have drive systems for driving reciprocation of a needle bar carrying a plurality of needles into and out of a backing material passing transversely underneath the needle bar. As the needles penetrate the backing material, they carry yarns into the backing material, where upon the yarns are caught by a looper to create a loop pile tufts, or by a hook or level cut loop looper and cut with a knife to create cut pile tufts. Typically, as a main drive shaft of the tufting machine rotates, the needle bar is reciprocated toward and away from the backing material. Such drive systems can, however, have drawbacks in terms of serviceability. For example, some drive systems utilize a series of individual drive assemblies mounted along the tufting machine and tied to the main drive shaft of the tufting machine, and also may include belt driven gear arrangements that drive push rods coupled to the needle bar for reciprocating the needle bar. However, when the belts of such drive assemblies wear out and/or break so as to require replacement, the entire drive system often must be substantially disassembled to enable access to the belts. In addition, the operational speeds of many conventional tufting machine drive systems often are limited, particularly for cut pile tufting machines.

What is needed, therefore, is an improved drive system for tufting machines that addresses the foregoing and other related and unrelated issues in the art. These include, but are not limited to needle drive systems for driving reciprocation of the needles of cut pile tufting machines at operational speeds similar to those of loop pile machines, and needle drive systems which provide for a durable and rugged apparatus that is efficient and easy to maintain.

SUMMARY

Briefly described, the present disclosure generally relates to tufting machines and methods of tufting. In embodiments, such tufting machine(s) can include a drive system for driving reciprocation of one or more needle bars thereof, and configured to provide improvements in driving the reciprocation of the one or more needle bars to form tufts of yarns in a backing material at increased production rates. The drive systems can be used for the formation of loop pile tufts, cut pile tufts, and/or combinations thereof, wherein production rates for tufted articles formed with cut pile tufts can be substantially matched to production rates for similarly formed tufted articles formed with loop pile tufts. Such tufted articles can include, for example and without limitation, carpets, artificial turf, and other tufted articles or materials.

In embodiments, the tufting machine can include one or more needle bars having a series of needles mounted therealong. The needles can be arranged in in-line, staggered, or in other arrangements along the one or more needle bars. A backing material can be fed through a tufting zone of the tufting machine with the needles penetrating into and out of the backing material with the reciprocation of the needle bars by the drive system. Yarns can be introduced into the backing material as the needles are reciprocated into and out of the backing material. In some embodiments, a shift mechanism can be provided for shifting the one or more needle bars transversely across the tufting zone. In other embodiments, multiple shift mechanisms can be utilized as needed.

The tufting machine further generally can include at least one yarn feed mechanism or pattern attachment for controlling the feeding of the yarns to their respective needles. In embodiments, such a yarn feed mechanism or pattern attachment can include, without limitation, various roll, scroll, servo-scroll, single end, double end, or multiple end yarn feed attachments. For example, in embodiments, a Yarntronics™, Infinity™ or Infinity IIE™ yarn feed mechanism or pattern attachment is manufactured by Card-Monroe Corp. Other types of yarn feed mechanisms can also be used.

In embodiments, the shift mechanism(s) and at least one yarn feed mechanism or pattern attachment generally can communicate with a control system of the tufting machine. For example, the shift mechanism(s) can receive instructions or communications from a control system for the tufting machine, for stepping or shifting the at least one needle bar transversely across the backing material in accordance with programmed and/or designed pattern shift steps for a pattern being tufted, so as to present the yarns carried thereby to tuft or stitch locations along/across the backing. In embodiments, the at least one yarn feed mechanism also can be operated to selectively control feeding of yarns to their associated needles for forming tufts of yarns, which can include forming tufts having selected pile heights and/or forming no tufts, to create the desired pattern appearance.

In addition, the tufting machine can include a gauge part assembly mounted below the backing, which in embodiments, can comprise a series of gauge parts that can include, for example and without limitation, loop pile loopers, cut pile hooks, level cut loop loopers, cut/loop clips, knives, etc. The gauge parts can be reciprocated into engagement with the needles as the needles penetrate the backing material to pick loops of yarns therefrom. In embodiments, a height or location of the gauge parts below the backing material, and, in some embodiments, the stroke or penetration depth of the needles through the backing, can be varied, in addition to adjusting the stroke or penetration depth of the needles through the backing material, to form varying loops of yarns of varying pile heights in the backing material, including formation of different pile height loops. Yarn feed control also can be used to control pile heights, for example, by pulling loops of yarns substantially low or out of the backing. In embodiments, various configurations and/or combinations of loop pile loopers, cut pile hooks, cut/loop hooks, level cut loopers or hooks, and/or other gauge parts can also be used.

In embodiments, the drive system for driving reciprocation of the needles of the tufting machine can include spaced first and second drive shafts disposed within the head of the tufting machine, the drive shafts extending generally parallel to each other along the head of the tufting machine and transversely across the backing material being fed through the tufting machine. The first and second drive shafts can include exposed ends that project through side plates at opposing sides of the tufting machine frame, the exposed ends being located outside the frame, projecting away from exterior surfaces of the side plates. In embodiments, the exposed ends of the first and second drive shafts include shaft drive gears mounted thereto and are coupled to a motor drive gear, sheave or sprocket of one or more main motors for driving the first and second drive shafts.

The drive system further can include a series of needle stroke or drive assemblies located along the head of the tufting machines, with the drive shafts extending therethrough. In embodiments, each of the needle stroke assemblies can include a series of needle stroke drive gears connected to and driven by drive members linked to the drive shafts. In embodiments, the drive members can include chains driven by alternating ones of the drive shafts such that the needle stroke drive gears of alternating ones of the needle stroke assemblies, e.g., odd number needle stroke assemblies can be rotated in one direction of rotation, while even number needle stroke assemblies can be rotated in an opposite direction. By rotating the drive shafts in opposite directions, a series of connecting rods, which can connect the needle stroke drive gears to a series of push rods coupled to the at least one needle bar are driven in a generally vertical direction or path of movement so as to translate the rotary motion of the first and second drive shafts to the push rods for driving the push rods in a linear, reciprocating motion, and the opposing rotational directions can allow the weight of the connecting rods to substantially counter-balance such motion and, in embodiments, the opposing rotations of the first and second drive shafts. In embodiments, counterweights also can be mounted on the first and second drive shafts to help balance and reduce/control vibration of the drive system as the needles are reciprocated into and out of the backing material.

In embodiments, the drive members of each of the needle stroke assemblies can be configured as double strand roller chains, which can include two paired rows or strands extending in a looped path about a first needle stroke drive gear attached to one of the drive shafts and about a second needle stroke drive gear attached to a secondary drive shaft. Other drive members also can be used.

In embodiments, the secondary shaft further can be coupled to a connecting rod so as to drive the connecting rod in an up and down motion with the rotation of the crank shaft. For example, in some embodiments, the secondary drive shaft can have a series of cam members mounted thereto in an offset arrangement, and with the cam members being coupled to the connecting rods for driving the reciprocating movement of the connecting rod and thus the push rod and the needle bar. In some embodiments, the secondary drive shaft can comprise a crank shaft coupled to the connecting rods for driving the reciprocating motion thereof. In addition, in embodiments, the drive chains can be configured to increase shaft horsepower and for easier repair and/or replacement without requiring removal of the first and second drive shafts from the needle stroke assemblies.

In embodiments, the drive system further can include a drive belt configured to encircle a motor drive gear mounted to the motor shaft of the one or more drive motors and shaft drive gears mounted to the ends of the drive shafts of the drive system, extending thereabout in a serpentine path. In embodiments, the drive belt and motor drive gear and drive shaft gears can comprise a high torque drive arrangement configured to enable the motors to drive the first and second drive shafts with increase horsepower and torque. The drive gears and drive belt further are mounted externally of the tufting machine, e.g., outside of an end box and along an exterior surface(s) of the tufting machine, further providing ease of maintenance. As the motor drive gears are driven by the motors, the drive belt drives the shaft drive gears, causing the first drive shaft to rotate in one direction and the second drive shaft to rotate in a reverse or opposite direction to the first drive shaft.

In embodiments, the drive belt can comprise a toothed timing belt having a series of spaced teeth, which, in embodiments, will include a series of curvilinear teeth. In some embodiments, the drive belt can comprise a double-sided curvilinear toothed timing belt. In other embodiments, the drive belt can comprise a double sided high torque belt having a series of teeth spaced therealong, which, in embodiments, can include a plurality of curvilinear teeth.

In embodiments, the drive belt can be extended around a tension adjusting gear located on an adjustable support. The adjustable support can be moveable along the side plate of the frame to which it is attached so as to move the tension adjusting gear with respect to the drive belt and adjust a tension therein, e.g., to take up slack in the drive belt.

In some aspects of the disclosure, a tufting machine is provided comprising: a frame having a base, spaced side portions, an end box, and a head extending between the side portions; at least one needle bar having a plurality of spaced needles mounted therealong, the needles carrying a plurality of yarns; wherein the at least one needle bar is moved in a reciprocating motion toward and away from the backing material as the backing material is moving through the tufting machine such that the needles penetrate the backing material to form tufts of the yarns in the backing material; and a drive system. In embodiments, the drive system comprises at least one motor mounted along at least one of the sides of the frame and having a motor drive shaft with a motor gear coupled thereto; first and second drive shafts extending along the head of the tufting machine, each of the first and second drive shafts having exposed ends that extend through the sides of the frame so as to project away from exterior surfaces of the frame; and a plurality of needle stroke assemblies located within the head of the frame and arranged at spaced positions along the first and second drive shafts, each needle stroke assembly comprising a plurality of needle stroke drive gears. The plurality of needle stroke drive gears can include a series of first needle stroke drive gears coupled to and driven by one of the first or second drive shafts, and a series of second needle stroke drive gears coupled to and driven by the first needle stroke gears by drive members. Rotation of the first and second drive shafts can cause rotation of the needle stroke drive gears of alternating needles stroke assemblies in opposite directions. A plurality of push rods can be coupled to the at least one needle bar and to the needle stroke drive gears for translating the rotation of the first and second drive shafts to a linear reciprocating motion of the at least one needle bar. The drive system further can comprise first and second shaft drive gears mounted to the exposed ends of the first and second drive shafts, the first and second drive gears located along an exterior surface of the side portion of the frame and outside of the end box of the frame; a tension adjusting gear located along the exterior surface of the side portion of the frame; a drive belt extending about the motor drive gear, the first and second shaft drive gears, and the tension adjusting gear; and an adjustable support on which the tension adjusting gear is mounted, the support configured to move along the exterior surface of the side portion of the frame to adjust a position of the tension adjusting gear with respect to the first and second drive gears to maintain a selected tension in the drive belt.

In embodiments of the tufting machine, the drive members comprise double strand size #60 roller chains. In some embodiments, the needle stroke assemblies each further comprise a mounting platform attached to the head of the frame and through which the drive shafts are extended.

In some embodiments of the tufting machine, the first needle stroke drive gears can be coupled to the first and second drive shafts in an alternating arrangement. For example, in embodiments, a first needle stroke drive gear of one of the needle stroke assemblies can be coupled to the first drive shaft, and a next first needle stroke drive gear of a next needle stroke assembly can be coupled to the second drive shaft in an alternating arrangement.

In some embodiments of the tufting machine, the drive belt comprises a double-sided modified curvilinear toothed timing belt. In embodiments, the drive belt comprises a width of at least about 2 inches to about 4 inches.

In embodiments of the tufting machine, the drive members comprise double strand roller chains each having a master connecting link configured to be removable from the double strand roller chains to enable removal of the drive members from the needle stroke drive gears.

In some embodiments, the tufting machine further comprises a plurality of gauge parts located below the backing material and configured to engage the needles and pull loops of yarns therefrom. In embodiments, the gauge parts can comprise cut pile hooks and knives for forming cut pile tufts of yarns in the backing material. In some embodiments, the gauge parts can comprise hooks, loopers, level cut loop looper or combinators thereof.

In some embodiments, an operational speed of the tufting machine for forming cut pile tufts can be at least approximately 1800 RPM.

In addition, in embodiments, the drive belt comprises a double-sided modified curvilinear toothed timing belt having a width of at least about 2 inches, and in embodiments, can include a poly-chain drive belt.

The present disclosure thus provides a tufting machine and a drive system for a tufting machine that enables operational speeds at increased rates, including operation of a tufting machine for forming cut pile tufts at similar operational speeds to loop pile tufting machines. In embodiments, the drive system further can be configured such that worn parts of the drive system can be readily and easily replaced and in which the driving and timing mechanism can be readily adjusted.

Various other objects, features and advantages of the present disclosure will become apparent from the following description when considered in conjunction with the accompanying drawings wherein like characters of reference designate corresponding parts throughout the several views.

BRIEF DESCRIPTION OF THE DRAWINGS

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced. Those skilled in the art further will appreciate and understand that, according to common practice, the various features of the drawings discussed below are not necessarily drawn to scale, and that the dimensions of various features and elements of the drawings may be expanded or reduced to more clearly illustrate the embodiments of the present disclosure described herein.

DETAILED DESCRIPTION

Referring now in detail to the embodiment chosen for the purpose of illustrating the present disclosure, FIGS. 1A-4 generally illustrate an embodiment of a tufting machine 10 having a drive system 5 for forming patterned tufted articles, according to the principles of the present disclosure, wherein stitches or tufts (FIG. 1A) of yarns Y can be inserted or placed at desired locations in a backing material B moving below the needles of the tufting machine and along a path of travel 6 through the tufting machine by operation of backing feed rolls 7.

Such tufts or stitches can be formed with various patterns, including having a multi-pile height tufted appearance. For example, the tufted article can be formed with the tufts of yarns formed at varying pile heights to provide sculptured looks, and with different color or type yarns for formation of multi-color patterns of various geometric and/or free-flowing designs. Additionally, it will be understood that various numbers of different type and/or color yarns (i.e., two color, three color, five color, six color, etc.), can be used to form multiple pile height patterned tufted articles according to the principles of the present disclosure.

Figure 1A:
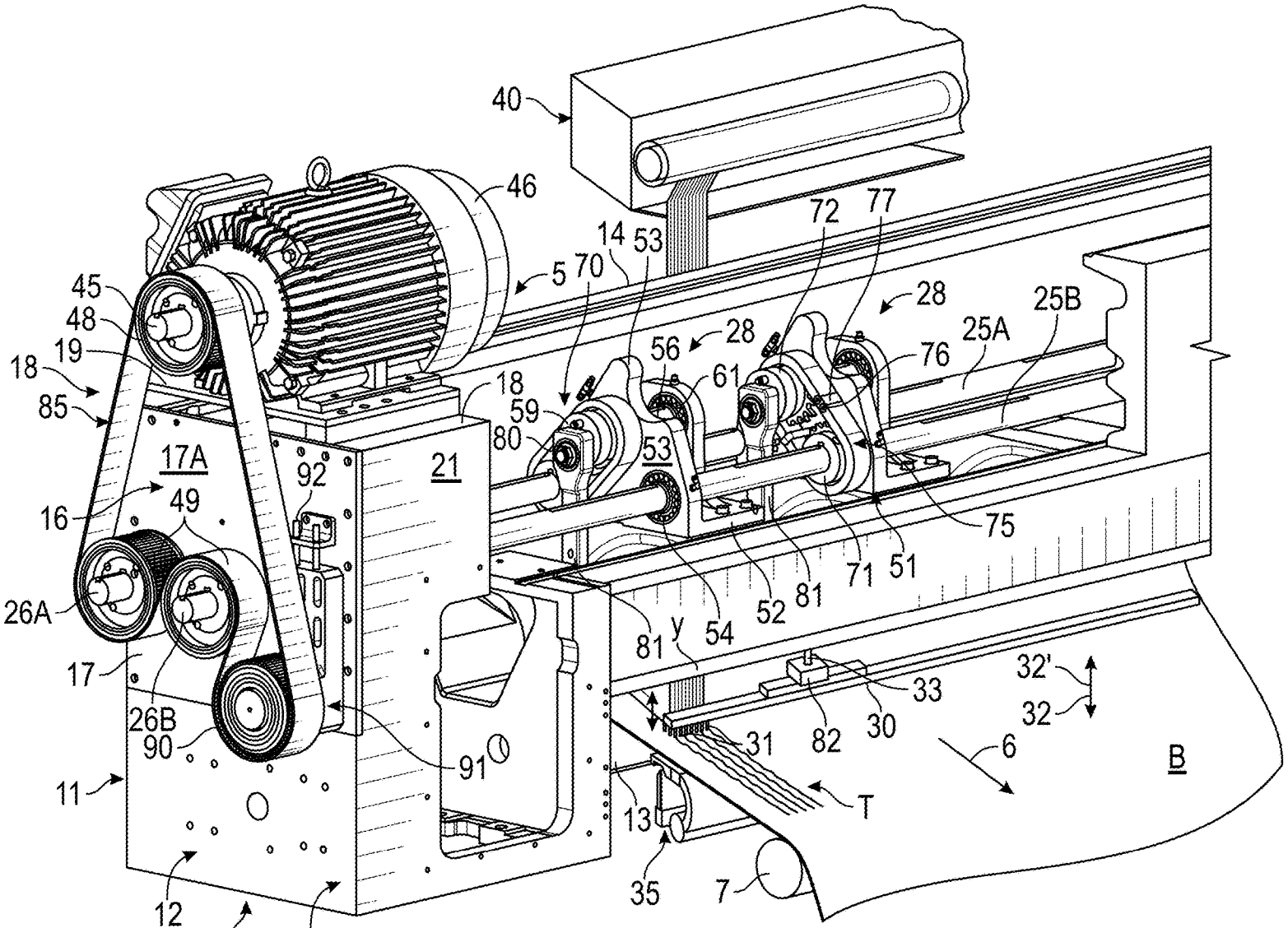
FIGS. 1A-1B are perspective views of an upper portion of the tufting machine, with parts broken away, schematically illustrating an embodiment of a tufting machine with a drive system for driving reciprocation of the needles of the tufting machine in accordance with principles of the present disclosure.

As illustrated in FIG. 1A, numeral 10 generally denotes a tufting machine including a frame 11 having a base 12 and a bed plate 13 that extends transversely across the machine and over which the backing material B is moved. The tufting machine 10 also includes a head 14 extending transversely across the frame of the tufting machine spaced above the bed plate 13. The frame 11 further has a pair of opposed vertically disposed spaced parallel sides 16 (only one of which is shown in FIG. 1A) having side plates 17 with exposed side surfaces 17A and an upper surface or portion 18 on which a motor support or plate 19 is mounted adjacent each. As further indicated in FIG. 1A, an end box 21 is formed along at least one side 16 of the frame. The end box 21 generally defines a chamber in which lubrication is applied to first and second drive shafts 25A/25B of the drive system 5, and to other operative components of the tufting machine (e.g., connection of a shifter of a needle bar, etc.), such as by applying an oil bath thereto inside the chamber of the end box.

As indicated in FIGS. 1A-2 and 4, the tufting machine 10 further will include one or more needle bars 30 coupled to a series of needle stroke or drive assemblies 28 of the drive system 5 by push rods 81 for reciprocating the at least one needle bar 30 toward and away from the backing material B in the direction of arrows 32/32'. A plurality of needles 31 are mounted along the one or more needle bars, typically being spaced at selected gauge increments, e.g., ⅛", 1/10", 5/16", etc. The needles 31 are carried with the at least one needle bar 30 as to be moved in a linear, reciprocating, up and down movement, by push rods 81 (as indicated by arrows 32/32') so that the needles penetrate into and out of the backing material B, to carry or insert the yarns Y into the backing for forming tufts therein. Loop pile tufts, cut pile tufts or combinations of loop and cut pile tufts can be formed in the backing material.

The at least one needle bar 30 further can be shiftable transversely across the width of the backing material, so as to shift or step the needles 31 in a direction that is transverse or generally perpendicular to the longitudinal path of travel 6 through the tufting machine. For example, a shift mechanism also can be linked to the one or more needle bars for shifting the at least one needle bar transversely across the backing material. The shift mechanism can include a Smart Step™ type shifter as manufactured by Card-Monroe Corp., or alternatively can include various other types of shift mechanisms including servo-motor or hydraulically controlled shifters, and/or pattern cam shifters as are conventionally used. Additional shift mechanisms including backing material or jute shifters, operable separately or in conjunction with a needle bar shifter, for shifting the backing material laterally with respect to the needles also can be used.

In embodiments, the needles 31 can be arranged in a single in-line row along one or more needle bars 30. In other embodiments, the needles 31 can be mounted in a staggered arrangement along a single needle bar or along a pair of needle bars, with offset rows of needles spaced transversely along the length of each needle bar and being staggered across the tufting zone of the tufting machine. Accordingly, while one example embodiment including a single needle bar 30 with an inline row of needles 31 arranged therealong may be generally indicated in FIGS. 1A-1B, the present disclosure is not limited to the use of a single needle bar or a particular configuration of needles. Instead, it will be understood by those skilled in the art that additional arrangements of one or more needle bars having spaced rows of needles that can be arranged in-line or in staggered or offset configurations, and both of which further can be shifted, also can be utilized in the tufting machine 10 incorporating the system according to the present disclosure.

Each of the needles generally will include a shank or body terminating at a pointed end, and including a take-off point or area where gauge parts 35 (FIG. 1B and FIG. 4) of a gauge part assembly can engage and pick-up yarns Y from the needles. As the needles are reciprocated in a substantially vertical motion, in the direction of arrows 32 and 32' (FIG. 2), the needles penetrate into and out of the backing material B along a stroke to a desired or predetermined penetration depth, carrying the yarns Y therewith, and will be selectively engaged by gauge parts 35 of the gauge part assembly to pick-up loops of the yarns from the needles.

It will be understood by those skilled in the art that in various embodiments, the gauge parts 35 can include loopers, hooks, level cut loop loopers, knives and other types of gauge parts. For example, in the present embodiment, the gauge parts can include a series of cut pile hooks and knives for forming cut pile tufts in the backing material. Other gauge parts, including loop pile loopers and level cut loop loopers, also can be used, such as to form loop pile tufts, and/or loop and cut pile tufts, loop pile loopers.

The gauge parts generally are disposed below the bed plate and are reciprocated toward and away from the needles for engaging and picking-up yarns inserted through the backing material (not shown), as the needles penetrate the backing material. The gauge parts further can be located at a fixed height to protrude through the loops sewn by the needles when the needles are at approximately bottom dead center and catch and temporarily hold the loops of yarns.

For example, the gauge parts 35 can be mounted below the bed of the tufting machine 10, spaced at a desired or selected distance to engage the needles 31 at a selected needle stroke or penetration depth. As the needles 31 penetrate the backing material, they are engaged by the gauge parts 35 of the gauge part assembly so as to pick-up and form loops of the yarns Y for forming tufts of yarns of selected colors or types in the backing material, and with selected lengths or pile heights.

In embodiments, at least some of the gauge parts 35 also can be slidably mounted within a gauge module, gauge block or other holder that can be mounted along a gauge bar or similar mount or attachment that couples the gauge parts to a drive mechanism for driving a reciprocating movement of the gauge parts in a direction toward and away from the needles. It further will be understood by those skilled in the art that various types of gauge parts, including cut pile hooks, loop pile loopers, level cut loop loopers, cut/loop clips or other gauge parts also can be used.

Figure 2:
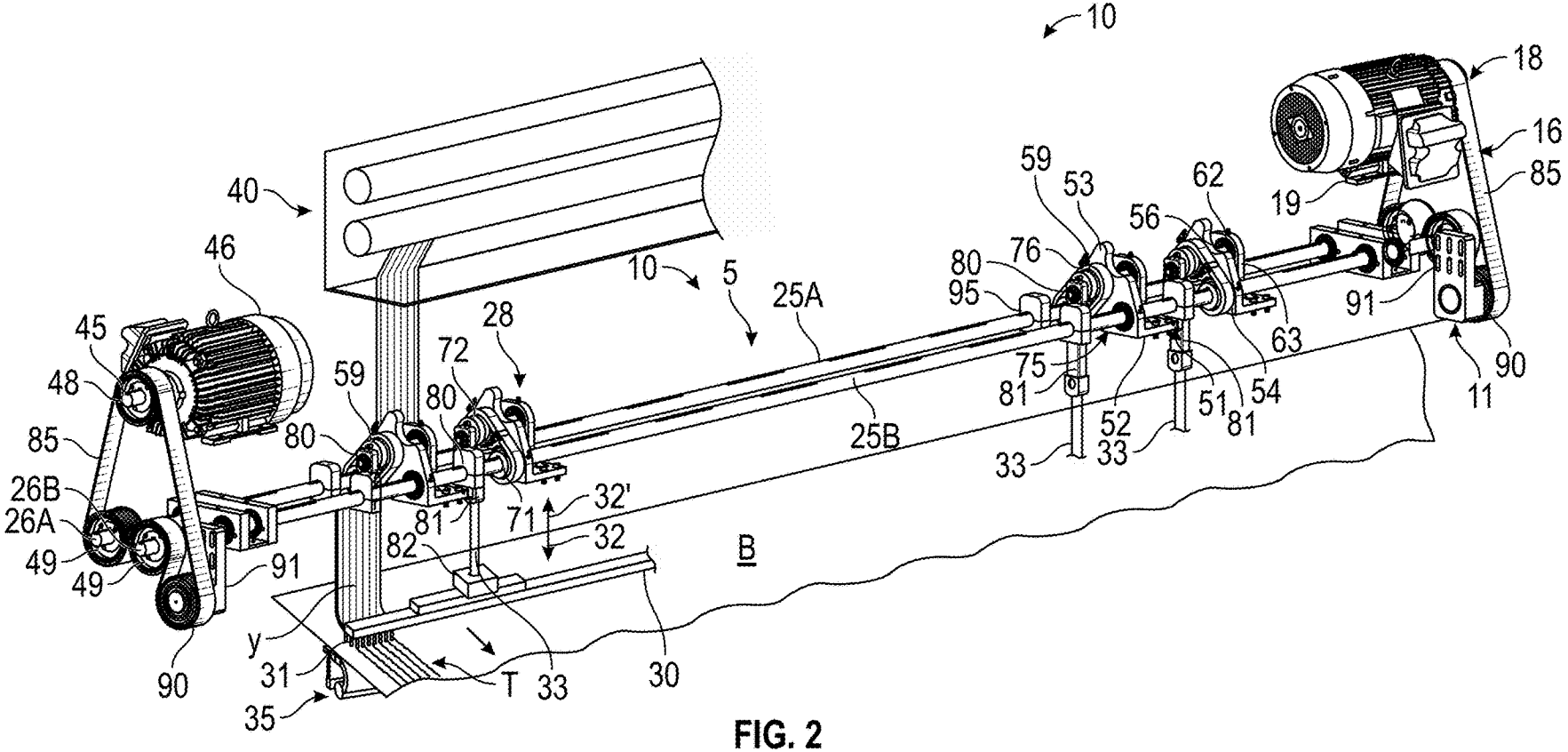
FIG. 2 is a perspective view the drive system for a tufting machine such as depicted in FIGS. 1A-1B.

One or more yarn feed mechanisms or pattern attachments 40 (FIGS. 1A, 2 and 4) further can be mounted to the frame 11 of the tufting machine 10 for controlling the feeding of the yarns Y to each of the needles during operation of the tufting machine. In various embodiments, a variety of yarn feed mechanisms or pattern attachments may be used, including, without limitation, yarn feed mechanisms or pattern attachments such as roll or scroll pattern attachments having one or more yarn feed rolls extending at least partially along the tufting machine and driven by motors under direction of a tufting machine control system, e.g., as schematically shown in FIGS. 1A and 2.

Figure 4:
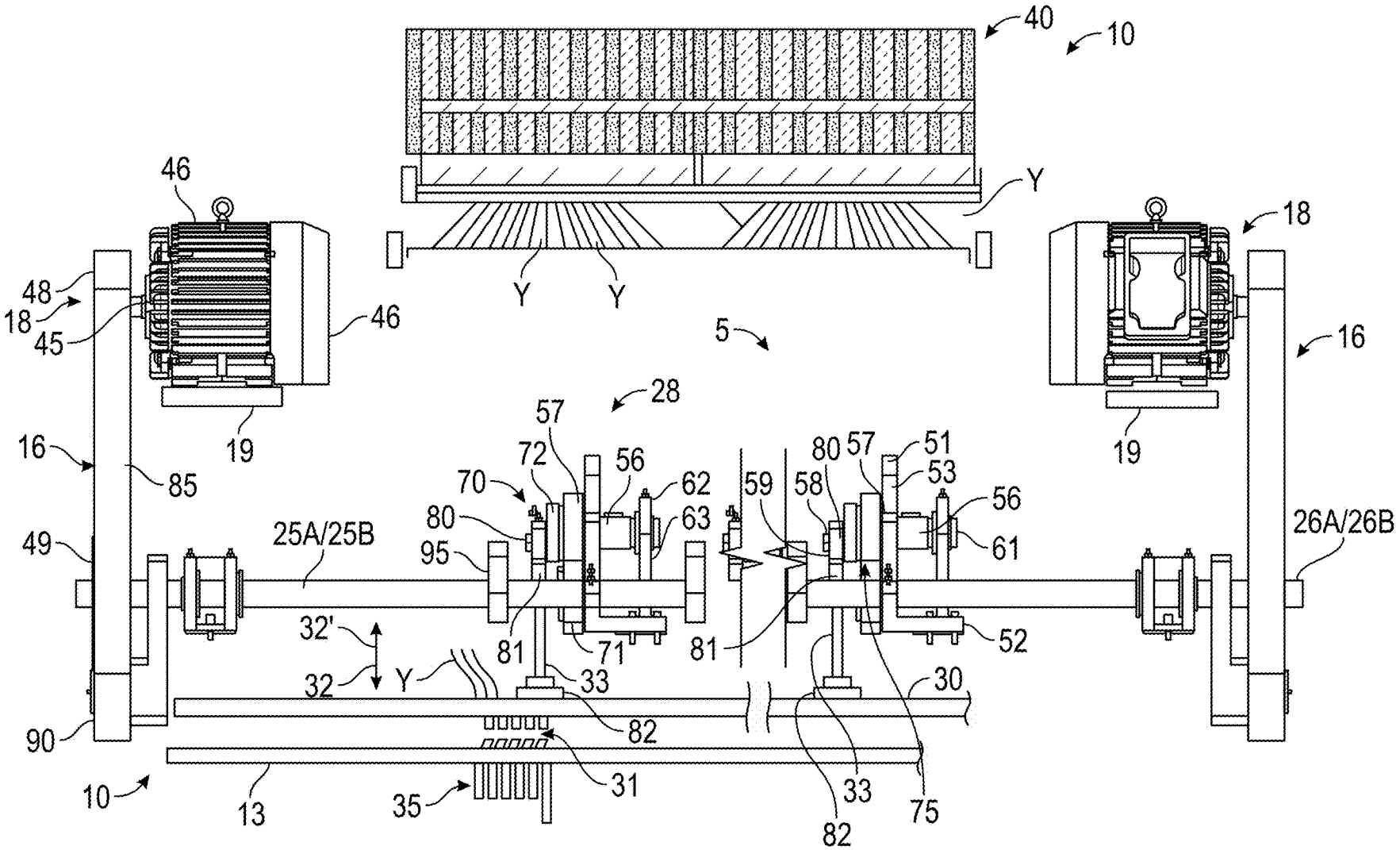
FIG. 4 is a schematic, side elevation view of the tufting machine drive system such as illustrated in FIGS. 1A-2.

In embodiments, other pattern yarn feed mechanisms or attachments having multiple yarn feed drives, each of which can include a motor and a feed roll for feeding yarns to selected needles, including the use of individual yarn feed devices for controlling the feeding of single yarns (or ends) or multiple ends of yarns (i.e., 2-4 or more yarns) to the needles 31, such as shown in FIG. 4, can be used. For example, in some embodiments, single end and/or multi-end yarn feed mechanisms of pattern attachments, such as Infinity™ and Infinity IIE™ systems as manufactured by Card-Monroe Corp, can be used. Additionally, in embodiments, multiple yarn feed mechanisms or pattern attachments can be mounted on one or both sides of the tufting machine, for feeding yarns to the needles of one or more needle bars 30.

The tufting machine further generally will include a control system configured for controlling the operation of the tufting machine 10, including control of the backing feed, control of the feeding of the yarns by the yarn feed attachment or mechanism, control of the driving/operating speed of a main drive shaft, e.g., one or more motor drive shafts 45 (FIGS. 1A-4) of one or more motors 46 of the drive system 5. For example, the control system can include programming configured to control the yarn feed mechanism or pattern attachment to selectively feed the yarns to their respective needles in cooperation with the other operative systems of the tufting machine, including the backing feed, shifting of the needle bars, and the operation of the gauge part assembly. In embodiments, the control system can control the presentation of a number of different colors or types of yarns into the backing material and the selective pick-up and retention of loops of selected yarns (e.g., yarns selected to appear in the face of the finished patterned article) to form tufts of such yarns with selected or desired pile heights and/or other texture effects across the width of the backing material.

In embodiments, the control system generally can comprise a tufting machine controller including a computer/processor or system controller and an operator interface, such as a touch screen, keyboard, mouse, etc., through which the operator can input patterns, make adjustments, etc. In some embodiments, the control system can comprise or include a stitch distribution control system, with the controller of the control system further including programming for control methodology for forming tufted patterns, including sculptured patterns having tufts formed at multiple pile heights, multi-color patterns, etc. In addition, one or more encoders, motor controls, and/or other, similar sensors adapted to monitor the rotation of the motor drive shafts and report the position(s) of the motor drive shafts to the control system can be provided for control of the operation of the tufting machine 10.

As illustrated in FIGS. 1-4, the drive system 5 generally includes at least one drive motor 46 for driving operation of a plurality of needle stroke assemblies 28. In the illustrated embodiment, by way of example and not limitation, a pair of motors 46 are shown in FIG. 4, mounted on opposite sides of the tufting machine frame. The motors 46 generally can include 20 horsepower (Hp) AC motors, and can include servo motors, stepper motors, or other types of drive motors. Other types of motors and different horsepower motors also can be used.

Figure 3:
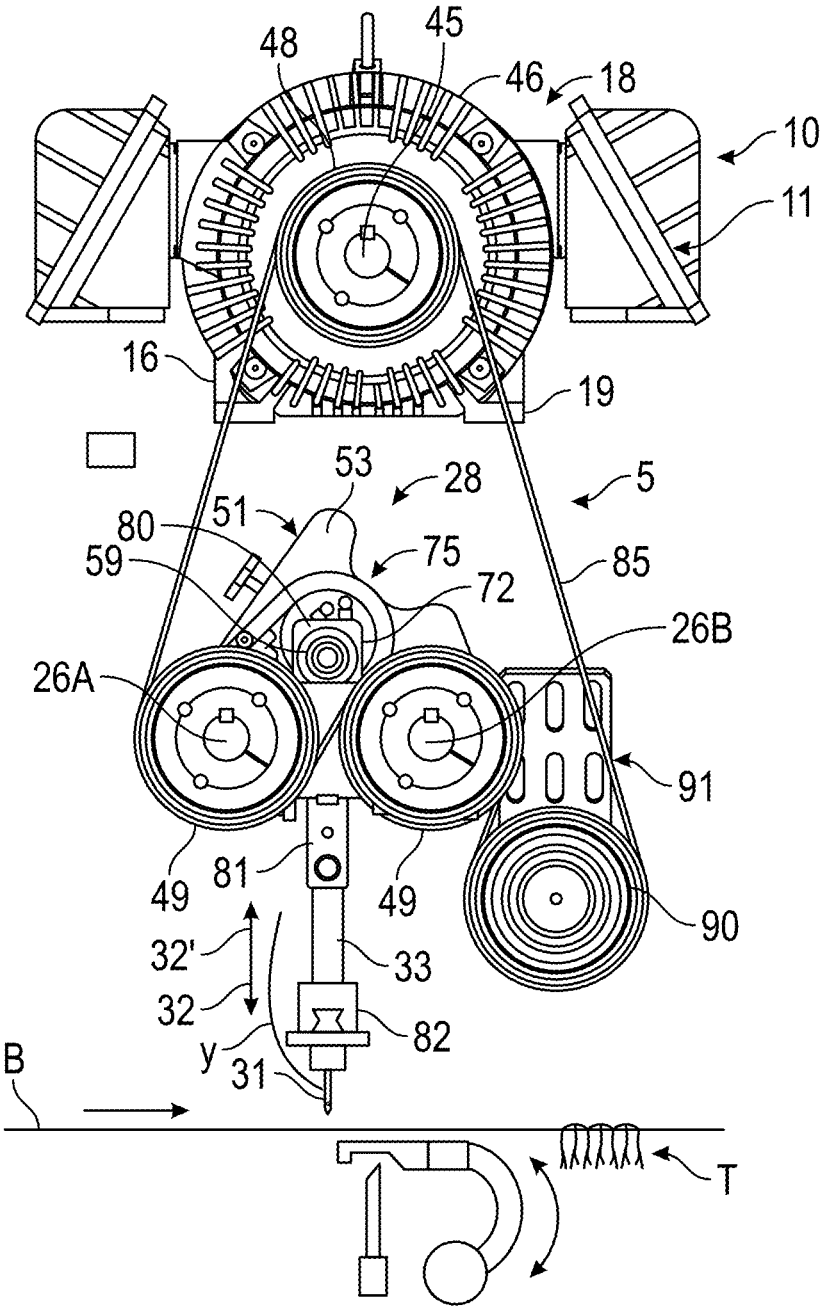
FIG. 3 is a vertical end view of the tufting machine drive system such as illustrated in FIGS. 1A-2.

In embodiments, the motors can be mounted on opposite sides of the frame of the tufting machine and, as shown, can be mounted on support plates or platforms 19 attached to the upper portion 18 of the tufting machine frame at each side 16 thereof, as indicated in FIGS. 1A, 3 and 4. Each motor further will include a motor drive shaft 45, a motor drive gear 48 mounted at a distal and thereof. In embodiments, the motor drive gear 48 can include a gear, sheave or sprocket. The motors 46 will be operated under control of the control system to drive the needle stroke assemblies 28 of the drive system 5 to cause reciprocation of the needle bar 30 during a tufting operation. As will be understood, the term "gear" can include gears, sprockets, pulleys, cogs, wheels, or other, similar transmission elements.

As illustrated in FIGS. 1A and 2, in embodiments, the drive system 5 further generally will include first and second drive shafts 25*a* and 25*b* that extend across the tufting machine, the first and second drive shafts generally being located along the head 14 of the frame 11 and extending transversely across the backing material B that is being fed through the tufting machine. Each of the first and second drive shafts can extend through the sides 16 of the tufting machine frame 11, including extending through the end box(es) 21, and through the side plates 17 mounted along the exterior facing surfaces of the sides 16 of the frame. The first and second drive shafts 25A/25B terminate at opposite exposed ends 26A/26B that project away from the exterior surfaces of the side plates 17, and are located outside of the frame of the tufting machine.

In embodiments, shaft drive gears 49 are mounted to each of the exposed ends 26A/26B of the first and second drive shafts, as indicated in FIGS. 1A-3. The shaft drive gears 49 can include gears, sprockets or sheaves. As further shown in FIGS. 1A-2 and 4, the first and second drive shafts extend through each of the plurality of needle stroke assemblies 28, which are mounted at spaced locations along the head 14 of the tufting machine frame 11.

In embodiments, each of the needle stroke assembly is 28 can includes a generally L-shaped frame 51 including a base portion 52 mounted to the head 14 of the tufting machine frame 11, such as by bolts or other fasteners, and an upstanding shaft support section 53. Each of the shaft support sections 53 generally can include the bearings or bushings 54 located adjacent a lower end of each shaft support section, and through which the first and second drive shafts 25A/25B are extended as shown in FIGS. 1A-2. In embodiments, these bearings or bushings 54 can rotatably support the first and second drive shafts extended through the shaft support sections, enabling rotation of the drive shafts therein.

Secondary drive shafts 56 or stud shafts can be rotatably received and project through each shaft support section 53 by bearings or bushings 57 mounted within the shaft support sections adjacent the upper ends 53A thereof. In embodiments, the secondary drive shafts will include a proximal end 58 protruding through the shaft support sections in a first direction and attached to a rotary cam member 59, and a distal end 61 that projects in an opposite direction through the support section and is engaged in rotatably supported by bearings 62 of a stub shaft support 63 formed with or attached to the supporting framework 51.

Figure 1B:
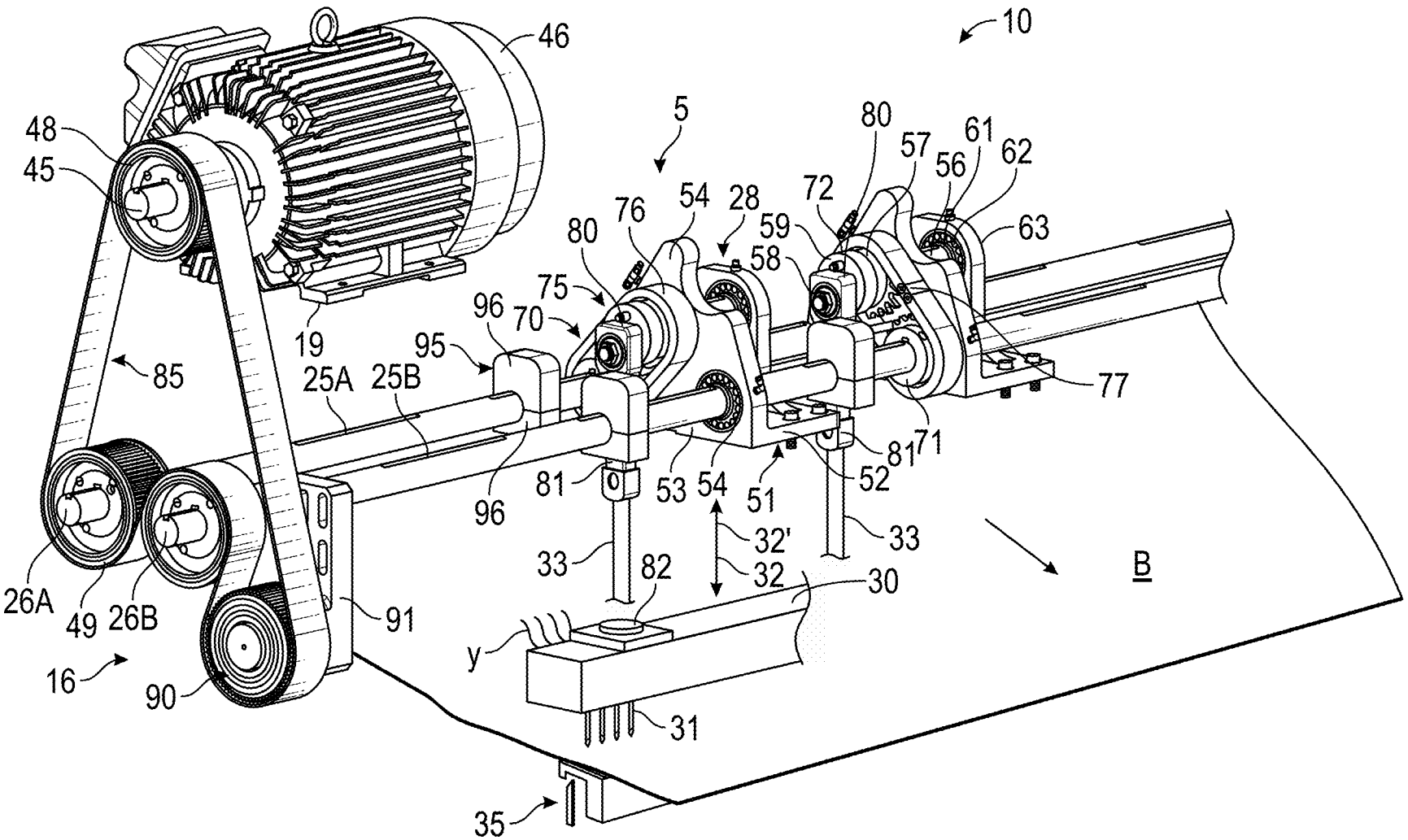

In embodiments, each needle stroke assembly 28 can further include a plurality or set of needle stroke drive gears 70. For example, in some embodiments, the needle stroke drive gears can include a first needle stroke drive gear 71 of the needle stroke drive gears of each needle stroke assembly 28 can be mounted along one of the first or second drive shafts 25A/25B, and a second needle stroke drive gear 72 that can be mounted to the secondary drive shaft 56 adjacent the proximal end thereof. In embodiments, the rotary cam member 59 further can be connected to the secondary drive shaft 56, such as shown in FIGS. 1A-B. The first and second needle stroke drive gears 71 and 72 of each needle support assembly 28 further can be coupled together in a driving relationship by drive members 75.

In embodiments, as shown in FIGS. 1A-1B, the drive members 75 can include belts and/or chains; for example, in some embodiments comprising double strand roller chains 76. By way of example, and not limitation, the drive members can include double strand size #60 drive chains. Each of the double strand drive chains 76 can include two rows or strands of chain links in a substantially endless looped path, and with a master connecting link 77 connecting the strands that can be disengaged so as to enable each drive chain to be released and removed from engagement with the first and second needle stroke drive gears 71 and 72.

In addition to providing or enabling significant increases in horsepower for driving reciprocation of the at least one needle bar, the drive chains further can be configured to facilitate efficiencies in maintenance and repair of the drive system 5 by enabling the drive chains to be detached and easily removed for repair and/or replacement of the drive chains, needle stroke drive gears, secondary drive shafts and/or other components of the needle stroke assemblies 28, but without requiring removal of the first and/or second drive shafts 25A/25B.

In embodiments, the drive members 75, for example, drive chains, belts or other, similar drive members, will be sized and configured to handle increases in horsepower (HP) up to approximately two to three times that of a conventional cut pile tufting machine. For example, in embodiments, the drive members can have a horsepower rating sufficient to withstand increases in horsepower driving rotation of the first and second drive shafts of the needle drive system from 30 HP to approximately 60 HP to upwards of 90 HP.

Enabling the use of drive members configured to accommodate such increases in horsepower in turn can enable the drive system to drive at least one needle bar 30 at increased speeds. For example, in embodiments featuring a cut pile tufting machine, the drive system 5 can be operable to drive reciprocation of at least one needle bar at the speeds approximately equivalent to speed obtainable with loop pile tufting machines, e.g. speeds of up to about 1500 rpm to about 2000 rpm. In embodiments, speeds of 1500 rpm to 1900 rpm, 1500 rpm to 1800 rpm, 1500 rpm to 1700 rpm, 1500 rpm to 1600 rpm, 1600 rpm to 2000 rpm, 1600 rpm to 1900 rpm, 1600 rpm to 1800 rpm, 1600 rpm to 1700 rpm, 1700 rpm to 2000 rpm, 1700 rpm to 1900 rpm, 1700 rpm to 1800 rpm, 1800 rpm to 2000 rpm, 1800 rpm to 1900 rpm, and 1900 rpm to 2000 rpm can be achieved, although greater speeds can also be anticipated.

As further indicated in FIGS. 1A-2, in embodiments, alternating needle stroke assemblies 28 of the drive system 5 can be linked to opposite ones of the first and second draft shafts 25A/25B. For example, the first needle stroke drive gear 71 of each odd needle stroke assembly can be coupled or mounted along the first drive shaft 25A, with the drive members of such needle support assemblies coupling their first needle stroke drive gears 71 to the second needle stroke drive gears 72 thereof for driving rotation of the secondary drive shafts 56 of the odd needle stroke assemblies in a first direction by rotation of the first drive shaft 25A. The first needle stroke drive gears 71 of even needle stroke assemblies 28 can be similarly coupled to or mounted along the second drive shafts 25B, with the drive chains 76 of the even needle stroke assemblies coupling the second drive shafts 25B to the second needle stroke drive gears 72 thereof for driving rotation of the secondary drive shafts 56 of each of the even needle stroke assemblies in an opposite, reversing direction upon rotation of the second drive shaft 25B.

In embodiments, each of the needle stroke assemblies 28 further can include a cam arm 80 having a first or upper end attached to the rotary cam member 59, and a second, distal end connected by a connecting rod 81 to one of the push rods 33; the push rods 33 being connected to at least one needle bar 30. As the first and second drive shafts 25A/25B are rotated, their rotation is translated via the needle stroke drive gears and drive members of each of the needle stroke assemblies to the secondary drive shafts 56 of each needle stroke assembly, which in turn rotates the rotary cam members 59 attached thereto. As the rotary cam members 59 are driven with the rotation of the first and second drive shafts 25A/25B, the cam arms 80 are driven in a reciprocating, up and down linear motion. This up and down motion is translated via the connecting rods 81 to the push rods 33, which can be coupled to at least one needle bar 30 by support bracket or foot 82, such that at least one needle bar is caused to reciprocate up and down in the direction of arrows 32 and 32' for reciprocating the needles 31 carried by at least one needle bar 30 into and out of the backing material B passing there below.

As indicated in FIGS. 1A, 1B and 3, in embodiments, a drive belt 85 is encircled or extends in a substantially serpentine path around the motor drive gear 48 and around the shaft drive gears 49 attached to the exposed ends 26A/26B of the first and second drive shafts 25A/25B. In embodiments, the drive belt and motor drive gear and drive shaft gears can comprise a high torque drive arrangement configured to enable the motors to drive the first and second drive shafts with increase horsepower and torque.

In embodiments, the drive belt 85 generally can comprise a double-sided modified curvilinear toothed timing belt, which, in some embodiments, can include a poly-chain belt. In embodiments, the drive belt can have an expanded width of approximately 3-4 inches; and in some embodiments, can have a width of approximately 2 inches to 6 inches, 2 inches to 5 inches, 2 inches to 4 inches, 2 inches to 3 inches, 3 inches to 6 inches, 3 inches to 5 inches, 4 inches to 6 inches, 4 inches to 5 inches, and 5 inches to 6 inches. Other widths can also be used.

In addition, in embodiments, the drive belt can comprise a toothed timing belt having a series of spaced teeth, which, in embodiments, will include a series of curvilinear teeth. In some embodiments, the drive belt can comprise a double-sided curvilinear toothed timing belt. In other embodiments, the drive belt can comprise a double sided high torque belt having a series of teeth spaced therealong, which, in embodiments, can include a plurality of curvilinear teeth.

As indicated in FIG. 3, the motor drive gear 48 and shaft drive gears 49 will be along the exterior, exposed or outer side surfaces along the sides 16 of the tufting machine frame 11. In this configuration, the drive belt 85 will not be exposed to lubricating materials (e.g., oils or other materials) that can degrade the drive belt, as can happen with prior drive systems in which the drive belt and drive connections with the drive shafts are included within the end box 21 of the tufting machine frame. As indicated, the drive belt extends around the motor drive gear 48 and around the shaft drive gears 49 attached to the exposed ends 26A/26B of the first and second drive shafts 25A/25B in a serpentine arrangement configured such that the rotation of the drive motor causes rotation of the first and second drive shafts in opposite, reversing directions.

As additionally indicated and illustrated in FIGS. 1A, 1B and 3, in embodiments, a tension adjusting or idler gear 90 can be located along the exposed surface of the side plate 17 at each side 16 of the tufting machine frame 11, generally being located in a position adjacent the drive shaft gears of the first and second drive shafts. In embodiments, the tension adjusting gear 90 generally can be mounted at a lower position relative to the drive shaft gears 49 of the first and second drive shafts 25A/25B, with the drive belt 85 further being extended or wrapped thereabout. In embodiments, the tension adjusting gear 90 further can be mounted along or on an adjustable support 91 that is moveably attached to or mounted along the side plate 17 of the tufting machine frame as illustrated in FIGS. 1A and 3.

In embodiments, the support 91 is adjustable or moveable in a vertically up and down direction along the side plate 17 of the tufting machine frame to enable adjustments in tension applied to the drive belt, e.g., to remove or take-up slack in the drive belt that may be created during operation of the drive belt over time. In embodiments, the support 91 can be mounted along a slide, a track, on rails 92, and/or other guide members such as indicated in FIG. 1A, to guide the support along a substantially linear path of movement with respect to the drive belt along the side plate 17. In embodiments, movement of the support 91, and thus the tension adjusting gear 90, can be controlled by an actuator such as a servo motor, cylinder, etc. operated under control of the tufting machine control system and/or controlled manually by an operator. For example, in embodiments, a sensor or detector can be provided, such as being positioned along one or more of the shaft gears and/or the tension adjusting gear, to detect slippage, slack, or a reduction in tension of the drive belt, and can provide an indication thereof to the controller of the control system, and/or can signal such a condition by an indicator such as a light, gauge, etc.

The drive belt 85 communicates or translates the rotation of the motor drive shaft 48 to the shaft drive gears 49 so as to rotate each of the first and second drive shafts in a synchronized, opposite reversing direction. As the first and second drive shafts 25A/25B are rotated, the drive members 75 of each of the needle stroke assemblies 28 translate such rotation to the secondary drive shafts 56, which in turn drive an eccentric movement of the cam arms 80 attached to the rotary cam members 59 such that the cam arms are moved in a reciprocating, up and down movement. In embodiments, timing of the movement of each of the cam arms can be arranged such that movement of the cam arms of each of the needle stroke assemblies can stop at a top dead center position approximately the same time and at bottom dead center at approximately the same time.

In addition, in some embodiments, the connecting rods 81 or push rods 33 that couple the cam arms 80 to the at least one needle bar 30 can be substituted so as to position the needle bar at prescribed location with respect to the backing material, in order to enable variations of the depth of penetration or stroke of the needles 31 into the backing material, without necessarily varying height of the bed plate. Alternatively, in embodiments, the bedplate and/or the gauge parts can be moveable to enable adjustments in the pile heights of the tufting of yarns formed in the backing material.

In general, the timing of the stroke of the alternately arranged cam arms 80 and connecting rods 81 of the needle stroke assemblies 28 can be selected to be approximately 180° out of phase with each other so that the needles 31 are fully raised as cam arms are at top dead center, and are fully lowered when the cam arms are at bottom dead center. The counter-rotating drive shafts 25A/25B thus rotate the secondary drive shafts 56 of the alternate needle stroke assemblies in counter-rotating directions so that the eccentric mountings of the cam arms to the rotary cam members drive cam arms and thus the connecting rods and push rods coupled thereto, in a synchronized, dynamically counter-balanced motion during the movement of the needle bar 30 in an upward/downward direction.

To further provide for dynamic counter-balancing, in some embodiments, the first and second drive shafts 25A/25B can provided with counter-balance weights 95 (FIGS. 1A-2), which can rotate with the first and second drive shafts. Such counter-balance weights will be selected and/or configured to help balance the first and second drive shafts driving rotation thereof and substantially dampen or cancel vertical forces created by the reciprocating motion of at least one needle bar 30.

In embodiments, the counter-balance weights 95 can include one or more pairs of opposed, rectangular clamp blocks 96, which can grip the first and second drive shafts 25A/25B from opposing sides so as to circumscribe and clamp the counter-balance weights 95 to the first and second drive shafts. The outer surfaces of the clamp blocks also can be configured to receive or attach to appropriate size offset weights. In embodiments, the counter-balanced weights can be disposed adjacent the cam arms 80 and connecting rods 81 respectively, and can be arranged in about a 180° out of phase relationship to each other.

By such an arrangement, the tufting machine 10 of the present disclosure can be substantially balanced during operation, and configured so that the tufting machine (including cut pile tufting machines) to operate at speeds that are generally equivalent to operational speeds of loop pile tufting machines. In embodiments, a cut pile tufting machine can be provided that can operate at speeds of 1,500 RPM-2,000 RPM or greater.

The tufting machine of the present disclosure further exhibits little vibration transmitted to the floor on which the machine 10 is mounted and/or which is transmitted to any yarn feed mechanism which might be associated with the machine. Furthermore, the noise of the machine is reduced so that the effect on the environment, when the machine 10 is running, is not as great as with the prior art machines.

In addition to the embodiments described above, embodiments of the present disclosure further relate to one or more of the following examples of embodiments of drive systems according to the principles of the present disclosure, which can include various embodiments features or elements and/or combinations of features steps or elements as disclosed herein. The following disclosed Examples further are not to be taken as limiting the scope of the present disclosure and any of the embodiments.

Example 1: A tufting machine comprising:

- a machine frame having sides, and a head extending between the sides;
- at least one needle bar having a plurality of spaced needles mounted therealong and configured to move in a reciprocating motion toward and away from a backing material moving through the tufting machine such that the needles penetrate the backing material for forming tufts of yarns in the backing material;
- a drive system comprising:
  - at least one motor mounted along at least one of the sides of the frame and having a motor drive shaft with a motor gear coupled thereto;
  - first and second drive shafts extending along the head of the tufting machine, each of the first and second drive shafts having exposed ends that extend through the sides of the frame;
  - a plurality of needle stroke assemblies arranged at spaced positions along the first and second drive shafts, each needle stroke assembly comprising:
    - pairs of needle stroke drive gears, each including one needle stroke drive gear coupled to and driven by one of the first and second drive shafts, and another needle stroke drive gear coupled to the one needle stroke drive gear to a secondary drive shaft;
    - drive members extending between and linking the needle stroke drive gears of each pair of needle stroke drive gears such that the secondary drive shaft is caused to rotate with rotation of the first and second drive shafts;
    - a plurality of push rods coupled to the at least one needle bar and to the secondary drive shafts; wherein as the secondary drive shafts are rotated with rotation of the first and second drive shafts, the plurality of push rods are driven in a linear motion to reciprocate the needles toward and away from the backing materials;

first and second shaft drive gears mounted to the exposed ends of the first and second drive shafts outside of an end box of the frame;

a tension adjusting gear located adjacent the first and second drive gears;

a drive belt extending about the motor drive gear, the first and second shaft drive gears, and the tension adjusting gear; and an adjustable support positioned along an exterior surface of the side of the frame, and on which the tension adjusting gear is mounted;

wherein the support configured to move along the exterior surface of the side of the frame to adjust a position of the tension adjusting gear with respect to the first and second drive gears to maintain a selected tension in the drive belt.

The tufting machine of Example 1, wherein the drive belt comprises a double sided curvilinear toothed timing belt.

The tufting machine of Example 1, wherein the drive members comprise double strand drive chains each having at least one connecting link configured to be disengaged so as to enable removal of the drive chains from about the needle stroke drive gears and respective push rod gears.

The tufting machine of Example 1, further comprising a plurality of gauge parts located below the backing material and configured to engage the needles and pick-up loops of yarns therefrom.

The tufting machine of Example 1, wherein the gauge parts comprise cut pile hooks and knives for forming cut pile tufts of yarns in the backing material.

The tufting machine of Example 1, wherein an operational speed of the tufting machine for forming cut pile tufts is at least approximately 1800 RPM.

The tufting machine of Example 1, wherein the drive belt comprises a poly-chain double sided curvilinear toothed timing belt having a width of between at least about 2 inches and about 6 inches.

The tufting machine of Example 1, wherein each needle stroke assembly further comprises a frame attached to the head of the machine frame, a pair of lower bearings through which the first and second drive shafts are received, and at least one upper bearing through which the secondary drive shaft is received.

Example 2: A tufting machine comprising:

a frame at least one needle bar having a plurality of spaced needles mounted therealong, the needles carrying a plurality of yarns;

a plurality of gauge parts configured to pick-up loops of yarns from the needles;

a drive system coupled to the at least one needle bar and comprising:

at least one motor mounted along the frame, the at least one motor including a motor drive shaft with a motor gear coupled thereto;

first and second drive shafts extending across the frame of the tufting machine, each of the first and second drive shafts having at least one exposed end that extends through a side of the frame and projects outwardly from an exterior surface of the side of the frame;

a plurality of needle stroke assemblies arranged at spaced positions along the first and second drive shafts, each needle stroke assembly comprising:

a plurality of needle stroke drive gears, including at least one drive needle stroke gear coupled to one of the first and second drive shafts, and at least one needle stroke drive gear coupled to a secondary drive shaft;

at least one drive member extending between the needle stroke drive gears and the needle stroke drive gears coupled to the secondary drive shaft; and at least one push rod coupled to the at least one needle bar and operatively connected to the secondary drive shaft and configured to translate rotation of the first and second drive shaft to a reciprocating motion of the at least one needle bar;

first and second shaft drive gears mounted to the exposed ends of the first and second drive shafts, the first and second drive gears located along the exterior surface of the side of the frame and outside of an end box of the frame;

a tension adjusting gear positioned adjacent at least one of the first and second drive gears; and a drive belt extending about the motor drive gear, the first and second shaft drive gears, and the tension adjusting gear so as to drive rotation of the first and second drive shafts;

wherein as the first and second drive shafts are rotated, the at least one needle bar is moved in a reciprocating motion toward and away from a backing material as the backing material is moving through the tufting machine such that the needles penetrate the backing material to form tufts of the yarns in the backing material; and wherein the tension adjusting gear is mounted on an adjustable support configured to move along the exterior surface of the side of the frame to adjust a position of the tension adjusting gear with respect to the first and second drive gears to maintain a selected tension in the drive belt.

The tufting machine of Example 2, further comprising one or more counter-balance weights attached to at least one of the first and second drive shafts, wherein the counter-balance weights are configured to substantially dampen vertical forces due to the reciprocating motion of the at least one needle bar.

The tufting machine of Example 2, wherein the drive members each include at least one connecting link configured to be disengaged so as to enable removal of the drive members from about the needle stroke drive gears and respective push rod gears.

The tufting machine of Example 2, wherein the gauge parts comprise cut pile hooks and knives for forming cut pile tufts of yarns in the backing material.

The tufting machine of Example 2, wherein an operational speed of the tufting machine for forming cut pile tufts in the backing material is at least approximately 1800 RPM.

The tufting machine of Example 2, wherein the drive belt comprises a poly-chain double sided modified curvilinear toothed timing belt having a width of between at least about 2 inches and about 5 inches.

Example 3: A tufting machine comprising:

a frame;

at least one needle bar having a plurality of spaced needles mounted therealong, the needles carrying a plurality of yarns;

a plurality of gauge parts configured to pick-up loops of yarns from the needles;

a drive system coupled to the at least one needle bar and comprising:

at least one motor mounted along the frame;

first and second drive shafts extending across the frame of the tufting machine, each of the first and second drive shafts having at least one exposed end that extends beyond a perimeter of the frame;

a plurality of needle stroke assemblies positioned along the first and second drive shafts, each needle stroke assembly comprising:

at least one drive member coupled to;

a rotary cam member operatively connected to the at least one drive member and configured to translate rotation of the first or second drive shaft to a reciprocating motion of the at least one needle bar;

a tension adjusting gear mounted on an adjustable support adjacent at least one exposed end of the first and second drive shafts; and a drive belt coupled to the motor, the first and second drive shafts, and the tension adjusting gear so as to drive rotation of the first and second drive shafts;

wherein as the first and second drive shafts are rotated, the at least one needle bar is moved in a reciprocating motion toward and away from a backing material as the backing material is moving through a tufting zone of the tufting machine such that the needles penetrate the backing material to form tufts of the yarns in the backing material.

The tufting machine of Example 3, the drive system further comprising a secondary drive shaft coupled to at least one of the first needle stroke drive gear and the second needle stroke drive gear such that the secondary drive shaft is caused to rotate with rotation of the first and second drive shafts.

The tufting machine of Example 3, wherein the needle stroke assemblies further comprise a plurality of needle stroke drive gears, including a first drive needle stroke gear coupled to one of the first and second drive shafts, and a second needle stroke drive gear coupled to a secondary drive shaft; wherein the drive members extend about and link the first and second needle stroke drive gears.

The tufting machine of Example 3, further comprising first and second drive gears mount to the exposed ends of the first and second drive shafts, and wherein the drive belt is extended about the first and second drive gears in a substantially serpentine path such that the first and second drive shafts rotate in opposite directions.

The tufting machine of Example 3, further comprising one or more counter-balance weights attached to at least one of the first and second drive shafts, the counter-balance weights configured to substantially dampen vertical forces due to the reciprocating motion of the at least one needle bar.

The tufting machine of Example 3, the one or more counter-balance weights comprising one or more pairs of opposed, rectangular clamp blocks positioned to grip the first and second drive shafts from opposing sides.

In the drawings and specification, embodiments of drive systems for driving a needle bar or multiple needle bars of a tufting machine have been disclosed, and although specific terms are employed, such terms are used in a descriptive sense only and not for purposes of limitation. In addition, while embodiments of the drive systems and methods of operation thereof have been described in detail with specific reference to the illustrated embodiments, it will, however, be understood by those skilled in the art that various changes and modifications can be made to the above-discussed construction of the present disclosure without departing from the spirit and scope of the present disclosure as disclosed herein, and that it is intended that all matter contained in the above description or shown in the accompanying drawings shall be interpreted as being illustrative, and not to be taken in a limiting sense.

Furthermore, the scope of the present disclosure shall be construed to cover various modifications, combinations, additions, alterations, etc., to the above-described embodiments, which shall be considered to be within the scope of the present disclosure. Accordingly, various features and characteristics of the present disclosure as discussed herein may be selectively interchanged and applied to other illustrated and non-illustrated embodiments of the present disclosure, and numerous variations, modifications, and additions further can be made thereto without departing from the spirit and scope of the present disclosure as set forth in the appended claims.

The invention claimed is:

1. A tufting machine, comprising:

at least one needle bar having a plurality of needles mounted therealong;

a drive system configured to drive the at least one needle bar in a reciprocating motion, the drive system comprising:

a first drive shaft coupled to a first drive motor by a drive belt and a second drive shaft coupled to a second drive motor by a drive belt;

wherein the first drive motor and the second drive motor are located at opposite sides of the tufting machine and are configured to drive rotation of the first and second drive shafts in opposite directions;

a plurality of first needle stroke assemblies coupled to the first drive shaft and to a series of push rods coupled to the at least one needle bar, and a plurality of second needle stroke assemblies coupled to the second drive shaft and to another series of push rods coupled to the at least one needle bar;

wherein the first needle stroke assemblies comprise:

a series of needle stroke drive gears coupled the first drive shaft and to a secondary drive shaft; and at least one drive member extending between and linking the needle stroke drive gears coupled to the first drive shaft and the secondary drive shaft such that the secondary drive shaft is caused to rotate with rotation of the first drive shaft;

wherein the second needle stroke assemblies comprise:

a series of needle stroke drive gears coupled the second drive shaft and to a secondary drive shaft; and at least one drive member extending between and linking the needle stroke drive gears coupled to the first drive shaft and the secondary drive shaft such that the secondary drive shaft is caused to rotate with rotation of the second drive shaft; and wherein the secondary drive shafts of the second needle stroke assemblies are driven in a counter-rotating direction from the secondary drive shafts of the first needle stroke assemblies so as to drive the push rods in a counter-balanced linear motion so as to reciprocate the needles toward and away from a backing material moving through the tufting machine.

2. The tufting machine of claim 1, further comprising a plurality of gauge parts positioned below the backing material and configured to pick-up yarns carried by the needles as the needles penetrate into the backing material.

3. The tufting machine of claim 1, wherein the first needle stroke assembly and the second needle stroke assembly are arranged in alternating positions along the first and second drive shafts and are configured to drive the linear motion of alternating ones of the push rods.

4. The tufting machine of claim 1, further comprising one or more counter-balance weights positioned along at least one of the first and second drive shafts, wherein the counter-balance weights are configured to substantially dampen vertical forces due to the reciprocating motion of the at least one needle bar.

5. The tufting machine of claim 4, wherein the one or more counter-balance weights include a series of blocks of one or more selected weights disposed along at least one of the first and second drive shafts.

6. The tufting machine of claim 1, wherein the at least one drive member of the first needle stroke assembly and the at least one drive member of the second needle stroke assembly each comprise at least one connecting link configured to be disengaged so as to enable removal of the at least one drive member from about the needle stroke drive gears.

7. A tufting machine comprising:

at least one needle bar having a plurality of needles mounted therealong;

a yarn feed configured to feed a plurality of yarns to the needles; and a drive system for driving reciprocation of the needles into and out of a backing material moving through the tufting machine, the drive system comprising:

a first drive shaft and a second drive shaft; and a plurality of needle stroke assemblies positioned along the first and second drive shafts, with alternating ones of the needle stroke assemblies linked to one of the first drive shaft or the second drive shaft;

wherein each needle stroke assembly comprises:

at least one needle stroke drive gear coupled to the first drive shaft or the second drive shaft and to at least one secondary drive shaft;

at least one drive chain extending between and linking the needle stroke drive gears coupled to the first drive shaft or the second drive shaft and the at least one secondary drive shaft of the needle stroke assembly such that the at least one secondary drive shaft is caused to rotate with rotation of the first drive shaft or the second drive shaft; and a plurality of push rods coupled to the at least one needle bar and to the needle stroke assemblies;

a first drive motor linked to the first drive shaft by a drive belt located along an exterior facing surface of a frame of the tufting machine and configured to drive rotation of the first drive shaft; and a second drive motor linked to the second drive shaft by a second drive belt located along a second exterior facing surface of the frame of the tufting machine and configured to drive rotation of the second drive shaft;

wherein the first and second drive motors are located along opposite sides of the tufting machine and are configured to drive rotation of the first and second drive shafts in opposing rotational directions so as to cause the one or more secondary drive shafts of the needle stroke assemblies linked to the second drive shaft to be driven in a counter-rotating direction from the one or more secondary drive shafts of the needle stroke assemblies linked to the first drive shaft; and wherein, in response to the counter-rotation of the one or more secondary drive shafts of the needle stroke assemblies, the push rods are driven in a counter-balanced linear motion so as to reciprocate the needles toward and away from the backing material.

8. The tufting machine of claim 7, further comprising a tension adjusting mechanism configured to adjust a tension in at least one of the drive belts.

9. The tufting machine of claim 7, wherein the at least one chain of each needle stroke assembly comprises at least one connecting link configured to be disengaged so as to enable removal of the at least one chain from about the needle stroke drive gears of the needle stroke assembly.

10. The tufting machine of claim 7, further comprising one or more counter-balance weights positioned along at least one of the first and second drive shafts, wherein the counter-balance weights are configured to substantially dampen vertical forces due to the reciprocation of the at least one needle bar.

11. The tufting machine of claim 7, further comprising a plurality of cut pile hooks and knives positioned below the backing material and configured to form cut pile tufts of the yarns in the backing material; and wherein an operational speed of the tufting machine for forming the cut pile tufts in the backing material is at least 1800 RPM.

* * * * *